US006537122B1

(12) United States Patent
Amey, Jr. et al.

(10) Patent No.: US 6,537,122 B1
(45) Date of Patent: Mar. 25, 2003

(54) ION BOMBARDED GRAPHITE ELECTRON EMITTERS

(75) Inventors: Daniel Irwin Amey, Jr., Durham, NC (US); Robert Joseph Bouchard, Wilmington, DE (US); Syed Ismat Ullah Shah, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/555,846

(22) PCT Filed: Dec. 8, 1998

(86) PCT No.: PCT/US98/26018

§ 371 (c)(1),
(2), (4) Date: Jun. 5, 2000

(87) PCT Pub. No.: WO99/31702

PCT Pub. Date: Jun. 24, 1999

Related U.S. Application Data

(60) Provisional application No. 60/069,457, filed on Dec. 15, 1997.

(51) Int. Cl.[7] ..... H01J 9/04; H01J 9/12

(52) U.S. Cl. ..... 445/51; 445/50; 427/77; 427/78

(58) Field of Search ..... 445/24, 51; 427/77, 427/78; 313/309, 310, 311, 336, 351

(56) References Cited

U.S. PATENT DOCUMENTS

| | | | | |
|---|---|---|---|---|
| 3,866,077 A | * | 2/1975 | Baker et al. | 313/336 |
| 4,857,799 A | | 8/1989 | Spindt et al. | |
| 5,015,912 A | | 5/1991 | Spindt et al. | |
| 5,089,742 A | * | 2/1992 | Kirkpatrick et al. | 313/351 |
| 6,020,677 A | * | 2/2000 | Blanchet-Fincher et al. | 313/309 |
| 6,057,637 A | * | 5/2000 | Zettl et al. | 313/310 |
| 6,239,547 B1 | * | 5/2001 | Uemura et al. | 313/309 |
| 6,376,973 B1 | * | 4/2002 | Blanchet-Fincher et al. | 313/309 |

FOREIGN PATENT DOCUMENTS

| | | |
|---|---|---|
| WO | WO 9415350 | 7/1994 |
| WO | WO 9415352 | 7/1994 |
| WO | WO 9428571 | 12/1994 |
| WO | WO 9706549 | 2/1997 |

OTHER PUBLICATIONS

J.A Floro, S. M. Rossnagel, and R. S. Robinson, "Ion–bombardment–induced wisker formation on graphite", Jul.–Sep. 1983, J.Vac.Sci.Technol.A1 (3), pp 1398–1402.*

* cited by examiner

*Primary Examiner*—Vip Patel
*Assistant Examiner*—Mariceli Santiago

(57) ABSTRACT

Patterned graphite electron emitters are disclosed. These field emitters find particular usefulness in field emitter cathodes and display panels. These graphite field emitters can be formed by screen printing a paste comprised of graphite and electrically insulating material (glass frit) in the desired patterned paste and bombarding the fire product with an ion beam.

6 Claims, No Drawings

ION BOMBARDED GRAPHITE ELECTRON EMITTERS

This application claims the benefit of provisional application 60/069,457 filed Dec. 12, 1997.

FIELD OF THE INVENTION

This invention provides patterned, ion bombarded graphite field emission electron emitters, a process for producing them and their use in field emitter cathodes in flat panel display screens.

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers and klystrons and in lighting.

Display screens are used in a wide variety of applications such as home and commercial televisions, laptop and desktop computers and indoor and outdoor advertising and information presentations. Flat panel displays are only a few inches thick in contrast to the deep cathode ray tube monitors found on most televisions and desktop computers. Flat panel displays are a necessity for laptop computers, but also provide advantages in weight and size for many of the other applications. Currently laptop computer flat panel displays use liquid crystals which can be switched from a transparent state to an opaque one by the application of small electrical signals. lIt is difficult to reliably produce these displays in sizes larger than that suitable for laptop computers or for operation over a wide temperature range.

Plasma displays have been used as an alternative to liquid crystal displays. A plasma display uses tiny pixel cells electrically charged gases to produce an image and requires relatively high electrical power to operate.

Flat panel displays having a cathode using a field emission electron source, i.e., a field emission material or field emitter, and a phosphor capable of emitting light upon bombardment by electrons emitted by the field emitter have been proposed. Such displays have the potential for providing the visual display advantages of the conventional cathode ray tube and the depth and weight advantages of the other flat panel displays with the additional advantage of lower power consumption than the other flat panel displays.

U.S. Pat. Nos. 4,857,799 and 51015,912 disclose matrix-addressed flat panel displays using micro-tip cathodes con structed of tungsten, molybdenum or silicon. WO 94-15352, WO 94-15350 and WO 94-28571 disclose flat panel displays wherein the cathodes have relatively flat emission surfaces.

Field emission has been observed in two kinds of nanotube carbon. structures. L. A. Chemozatonskii eti al., Chem. Phys. Letters 233, 63 (1995) and Mat. Res. Soc. Symp. Proc. Vol. 359, 99 (1995) have produced films of nanotube carbon structures on various substrates by the electron evaporation of graphite in $10^{-5}$–$10^{-6}$ torr. These films consist of aligned tube-like carbon molecules standing next to one another. Two types of tube-like molecules are formed; the A-tubelites whose structure includes single-layer graphite-like tubules forming filaments-bundles 10–30 nm in diameter and the B-tubelites, including mostly multilayer graphite-like tubes 10–30 nm in diameter with conoid or dome-like caps. They report considerable field electron emission from the surface of these structures and attribute it to the high concentration of the field at the nanodimensional tips. B. H. Fishbine et:al., Mat. Res. Soc. Symp. Proc. Vol. 359, 93 (1995) discuss experiments and theory directed towards the development of a buckytube (i.e., a carbon nanotube) cold; field emitter array cathode.

R. S. Robinson et al., J. Vac. Sci. Technolo. 21, 1398 (1983) disclose the formation of cones on the surfaces of substrates under ion bombardment. The effect was reported for various substrate materials and were generated by simultaneously sputtering a surface at high energy while seeding it with impurity atoms deposited at low energy. They also disclosed the formation of carbon whiskers up to 50 $\mu$m in length when a graphite substrate was ion-bombarded with impurities from a stainless steel target.

J. A. Floro et al., J. Vac. Sci. Technolo. A 1, 1398 (1983) disclose the formation of whiskers during relatively high current density ion bombardment of heated graphite substrates. The whiskers were disclosed to be 2–50 $\mu$m in length and 0.05–0.5 $\mu$m in diameter and to grow parallel to the ion beam. Simultaneous impurity seeding was reported to inhibit whisker growth. J. A. van Vechten et al., J. Crystal Growth 82, 289 (1987) discuss the growth of whiskers from graphite surfaces under ion sputtering conditions. They note that the whiskers of smallest diameter, characteristically about 15 nm, definitely appear to be different from either diamond or the scrolled-graphite structure found in carbon fibers grown by catalytic pyrolysis of hydrocarbons. Larger whiskers with diameters ranging from 30 to 100 nm were also observed to g'row in sputtering systems. The smaller diameter whiskers are constant in diameter along the length while the larger diameter whiskers may have a slight taper.

M. S. Dresselhauset al., Graphite Fibers and Filaments (Springer-Verlag, Berlin, 1988), pp. 32–34, disclose that filaments may be grown on several types of hexagonal carbon surfaces, but not on diamond or glassy carbon.

T. Asano et al., J. Vac. Sci. Technol. B 13, 431 (1995) disclose increased electron emission from diamond films which have been deposited on silicon by chemical vapor deposition, argon ion milled to form diamond cones and then annealed at 600° C. These cones are formed if the diamond is in the form of isolated grains.

C. Nüitzenadel et.al., Appl. Phys. Lett. 69, 2662 (1996) disclose field emission from cones etched into both synthetic boron-doped diamond and silicon by ion sputtering.

S. Bajic et al., J. Phys. D: Appi. Phys. 21, 200 (1988) disclose a field emitter composite with graphite particles suspended in a resin layer.

R. A. Tuck et al., WO 97/06549, disclose a field emission material comprising an electrically conductive substrate and, disposed thereon, electrically conductive particles embedded in, formed in, or coated by a layer of inorganic electrically insulating material to define a first thickness of the insulating material between the particle and the substrate and a second thickness of the insulating material between the particle and the environment. The field emitting material may be printed onto a substrate.

There is a need for a process for readily and economically producing both small and large sized highly emitting field emission electron emitters for use in various flat panel applications.

SUMMARY OF THE INVENTION

This invention provides a process for producing a field emission electron emitter, which comprises:

(a) forming a layer of composite which comprises graphite particles embedded in a matrix material which comprises electrically insulating material, wherein the matrix material adheres to a substrate and to the graphite particles thereby affixing the graphite particles to one another and to the substrate and wherein the graphite particles are essentially completely surrounded by the matrix material, and (b) bombarding the surf ace of the layer formed in (a) with an ion beam.

Preferably the ion beam is an argon ion beam and the argon ion beam has an ion current density of from about 0.1 $mA/cm^2$ to about 1.5 $mA/cm^2$, a beam energy of from about 0.5 keV to about 2.5 keV and a period of ion bombardment of at least about 15 minutes.

Preferably the electrically insulating material is glass and most preferably, a glass with a low softening point.

Preferably, when the layer of composite comprises graphite and glass, the process for forming the layer of composite on a substrate comprises screen printing a paste comprised of graphite particles and glass frit onto the substrate in the desired pattern and firing the patterned paste. For a wider variety of applications, e.g., those requiring finter resolution, the preferred process comprises screen printing a paste which further comprises a photoinitiator and a photohardenable monomer, photopatteining the dried paste and firing the patterned paste.

This invention also provides a process for producing a field emission electron emitter wherein the matrix material further comprises electrically conducting material. Preferably the electrically conducting material is silver or gold.

Preferably, when the layer of composite further comprises an electrically conducting material, the process for forming the layer of composite on a substrate comprises screen printing a paste comprised of graphite, glass frit and an electrically conducting material onto the substrate in the desired pattern and firing the patterned paste. For a wider variety of applications, e.g., those requiring finer resolution, the preferred process comprises screen printing a paste which further comprises a photoinitiator and a photo hardenable monomer, photopatterning the dried paste and firing the patterned paste.

This invention also provides a screen printable or coatable paste that can be used in the preferred process for embedding graphite particles in glass. The paste contains solids comprised of graphite particles and glass frit.

This invention also provides electron emitters produced by the process of this invention. These electron emitters and field emitter cathodes made therefrom are useful in vacuum electronic devices, flat panel computer and television displays, emission gate amplifiers, klystrons and lighting devices. The flat panel displays can be planar or curved.

DETAILED DESCRIPTION OF THE INVENTION

The process of the invention for producing a field emission electron emitter comprises embedding graphite particles in a matrix which comprises electrically insulating material and may further comprise electrically conducting material. The matrix material adheres to a substrate and the graphite particles are embedded within the matrix and are thereby affixed to the substrate. The graphite particles are essentially completely surrounded by matrix material.

As used herein, "graphite particles" means the particles of the usual hexagonal graphite as well as particles of amorphous carbon which are microcrystalline forms of graphite.

As used herein, "essentially completely surrounded by the matrix material" means that the graphite particles are embedded or encased within or coated by the matrix material. Some small portions of the some of the graphite particles may not be coated by the matrix material.

Preferably the electrically insulating material is glass and most preferably, a glass with a low softening point.

Various processes can be used to embed the graphite particles in the matrix material, but the preferred process is to screen print a paste comprised of graphite particles and matrix material, e.g., glass frit or glass frit and a good electrically conducting metal, onto a substrate. The dried paste is then photopatterned and the patterned paste fired. Alternatively, the desired pattern of paste is formed during the screen printing step and the dried paste is then fired. The patterned paste is fired to soften the glass frit and cause it to adhere to the substrate and to portions of the graphite particles thereby affixing the graphite particles to one another and to the substrate to produce the layer of composite.

The substrate can be any material to which the matrix material will adhere. Non-conducting substrates will require a film of an electrical conductor to serve as the cathode electrode and provide means to apply a voltage to and supply electrons to the graphite particles. Silicon, a glass, a metal or a refractory material such as alumina can serve as the substrate.

As used herein, "substrate" means the structure on which the layer of composite is formed, either a single material or a combination of materials, e.g., a non-conducting material such as glass with a layer of an electrical conductor. A preferred technique for providing such an electrically conducting layer is to form a conducting composite by screen printing and firing a silver or gold conductor composition.

When screen printing or photopatterning is used to form a layer of composite, the preferable substrate is glass and soda lime glass is especially preferred.

The paste used for screen printing typically contains graphite particles, low softening point glass frit, an organic medium, solvent and surfactant. The role of the medium and solvent is to suspend and disperse the particulate constituents, i.e., the solids, in the paste with a pro per rheology for typical patterning processes such as screen printing. There are a large number of such mediums known in the art. Examples of resins that can be hused are cellulosic resins such as ethyl cellulose and alkyd resins of various molecular weights. Butyl carbitol, butyl carbitol acetate, dibutyl carbitol, dibutyl phthalate and terpineol are examples of useful solvents. These and other solvents are formulated to obtain the desired viscosity and volatility requirements. A surfactant can be used to improve the dispersion of the particles. Organic acids such oleic and stearic acids and organic phosphates such as lecithin or Gafac® phosphates are typical surfactants. A glass frit that softens sufficiently at the firing temperature to adhere to the substrate and to the graphite particles is required Preferably the graphite particles have least dimensions of 1 $\mu$m. If a layer of composite with higher electrical conductivity is desired, the paste also contains a metal such as silver or gold. Since the graphite particles are to be surrounded by glass it would be appropriate to add a wetting agent such as lead nitrate to the paste to promote the wetting of the graphite particles by the glass. Variations in the composition can be used to adjust the viscosity and the final thickness of the printed material.

The paste is typically prepared by milling a mixture of graphite particles, low softening point glass frit, organic medium, surfactant, a wetting agent and a solvent. The paste mixture can be screen printed using well-known screen printing techniques, e.g., by using a 165–400 mesh stainless steel screen. The paste is deposited in the form of a desired pattern, e.g., discrete elements, interconnected areas or a continuous film. The screen-printed paste is dried before firing, typically by heating at 125° C., for about 10 minutes. When the substrate comprises glass, the dried paste is then fired at a temperature of about 450° C. to about 575° C., preferably at about 525° C., for about 10 minutes. Higher firing temperatures can be used with substrates which can endure them. It is during this firing step that the organic materials are volatilized leaving the layer of composite comprised of graphite particles and glass. Surprisingly, the graphite particles undergo no appreciable oxidation or other chemical or physical change during the firing.

If the screen-printed paste is to be photopatterned, the paste contains a photoinitiator and a photohardenable monomer comprised, for example, of at least one addition polymerizable ethylenically unsaturated compound having at least one polymerizable ethylenic group.

The layer of deposited paste decreases in thickness upon firing. Preferably, the thickness of the fired layer of composite is from about 5 $\mu$m to about 30 $\mu$m.

The layer of composite which comprises graphite particles and glass on a substrate can be subsequently treated to produce a field emission electron emitter. For example, the layer of composite is then subjected to ion beam bombardment under the following conditions. Beams of argon, neon, krypton or xenon ions can be used. Argon ions are preferred. The pressure during this bombardment is about $0.5\times10^{-4}$ torr ($0.7\times10^{-2}$ Pa) to about $5\times10^{-4}$ torr ($6.7\times10^{-2}$ Pa). The ion beam bombardment is carried out at ion current densities of about 0.1 mA/cm$^2$ to about 1.5 mA/cm$^2$, preferably about 1.5 mA/cm$^2$ to about 1.2 mA/cm$^2$, with beam energies of about 0.5 keV to about 2.5 keV, preferably about 1.0 keV to about 1.5 keV. Bombardment times of about 10 minutes to 90 minutes or more can be used. Under these conditions, glass is removed from the graphite particles near the surface of the layer of composite to expose the graphite and whiskers and cones are formed on the graphite particle surfaces. The resulting product will be a good field emission electron emitter. Ranges of the exposure times and optimal exposure times depend on the other bombardment conditions. Bombardment must be for a time sufficient to result in the removal of the glass from the graphite particles and the formation of the whiskers and cones on the graphite particles.

Any ion source can be used. Currently Kaufmann Ion Sources are the most readily available commercially.

The surface structure of the layer of composite will change significantly during the ion bombardment. Glass is removed from the surfaces of the graphite particles at the layer surface. As a result of etching, it is no longer smooth, but instead becomes textured with the formation of cones on the graphite particles. Diameters of the cones range from about 0.1 $\mu$m to about 0.5 $\mu$m. The cones develop in the direction toward the incident ion beam so that when ion beam etching is carried out at angles other than 90° (e.g., normal to the surface), the cones are not normal to the surface. The graphite etches uniformly over the area bombarded, i.e., the density of the cones (the number of cones per unit area) and the appearance of the cones is uniform.

Transmission electron micrographs of the cones formed will indicate that they consist of small grains of crystalline carbon. A cone is believed to be that part of the original graphite surface which is left behind following ion beam etching.

In addition to the cones, whiskers are also formed during ion bombardment of the graphite particle surfaces. Whiskers are typically located at the tips of the cones. The lengths of the whiskers can extend from 2 $\mu$m to distances of 20 $\mu$m or more. The lengths of the whiskers can be much greater than the initial dimensions of the graphite particles. Diameters of the whiskers are in the range of 0.5 to 50 nm. The whiskers form in the direction toward the incident ion beam. The whiskers are flexible, and will move during scanning electron microscopy measurements.

A 3 cm-diameter ion gun (Kauffman Ion Source, Model II) can be used to create an argon ion beam of about 2 inches diameter (5 cm) at the sample surface. This is a turbo-pumped system with a base pressure of $1\times10^{-8}$ torr ($1.3\times10^{-6}$ Pa). After the base pressure is reached, the working gas, argon, is fed into the system through a needle valve until a steady working pressure of $1\times10^{-4}$ torr ($1.3\times10^{-2}$ Pa) was achieved. The distance between the ion gun and the surface is 4–5 inches (10–12.5 cm).

Transmission electron micrographs of the whiskers will indicate that they are solid and consist of amorphous carbon. This material is believed to be carbon which has been removed from the original graphite particles by ion beam etching and then redeposited, initially typically at the tips of cones and then at the tips of the growing whiskers. Alternately, the whiskers may form by carbon activated by the ion beam which diffuses to the tips of the cones or whiskers. These carbon whiskers differ in structure from carbon nanotubes. Carbon nanotubes are hollow and contain shells of graphite-like sheets of carbon. Carbon whiskers are solid and exhibit no long range crystalline order in any direction.

Field emission tests can be carried out on the resulting samples using a flat-plate emission measurement unit comprised of two electrodes, one serving as the anode or collector and the other serving as the cathode. The unit is comprised of two square copper plates, 1.5 in by 1.5 in (3.8 cm×3.8 cm), with all corners and edges rounded to minimize electrical arcing. Each copper plate is embedded in a separate polytetrafluoroethylene (PTFE) block, 2.5 in×2.5 in (4.3 cm×4.3 cm), with one 1.5 in by 1.5 in (3.8 cm×3.8 cm) copper plate surface exposed on the front side of the PTFE block. Electrical contact to the copper plate is made by a metal screw through the back of the PTFE block and extending into the copper plate, thereby providing a means to apply an electrical voltage to the plate and means to hold the copper plate firmly in place. The two PTFE blocks are positioned with the two exposed copper plate surfaces facing one another and in register with the distance between the plates fixed by means of glass spacers placed between the PTFE blocks but distanced from the copper plates to avoid surface leakage currents or arcing. The separation distance between the electrodes can be adjusted, but once chosen, it is fixed for a given set of measurements on a sample. Typically, separations of 0.5 mm to about 2 mm can be used.

The sample is placed on the copper plate serving as the cathode. In the case of a conducting substrate, a sample can be held in place and electrical contact made by applying a small drop of carbon paint to the back of the sample and allowing it to dry. In the case of an insulating substrate with a conducting film, the substrate is held down on two sides with conducting copper tape, which also serves to provide for electrical contact.

The test apparatus is inserted into a vacuum system, and the system is evacuated to a base pressure below $1\times10^{-6}$ torr ($1.3\times10^{-4}$ Pa). A negative voltage is applied to the cathode and the emission current is measured as a function of the applied voltage. The separation distance between the plates is measured.

What is claimed is:

1. A process for producing a field emission electron emitter, which comprises:

(a) forming a layer of composite which comprises graphite particles embedded in a matrix material which comprises electrically insulating material, wherein said matrix material adheres to a substrate and to said graphite particles thereby affixing said graphite particles to one another and to said substrate and wherein said graphite particles are essentially completely surrounded by said matrix material; and (b) bombarding the surface of the layer formed in (a) with an ion beam which comprises ions of argon, neon, krypton or xenon for a time sufficient to remove said matrix material near the surface of said layer of composite to expose said graphite particles and form whiskers on said graphite particles.

2. The process of claim 1, wherein said ion beam comprises ions of argon.

3. The process of claim 2, wherein said ion beam has a beam energy of from about 0.5 keV to about 2.5 keV.

4. The process of claim 2, wherein said electrically insulating material is glass.

5. The process of claim 4, wherein said layer of composite is formed by a process, which comprises:

(a) screen printing a paste comprised of graphite particles and glass frit onto said substrate in the desired pattern; and (b) firing the dried patterned paste to soften said glass frit and cause it to adhere to said substrate and to portions of said graphite particles thereby affixing said graphite particles to one another and to said substrate to produce said layer of composite.

6. The process of claim 4, wherein said layer of composite is formed by a process, which comprises:

(a) screen printing a paste comprised of graphite particles, glass frit, a photoinitiator and a photohardenable monomer frit onto said substrate in the desired pattern;

(b) photopatterning the dried paste; and (c) firing the patterned dried paste to soften said glass frit and cause it to adhere to said substrate and to portions of said graphite particles thereby affixing said graphite particles to one another and to said substrate to produce said layer of composite.

* * * * *